United States Patent [19]

Paepke

[11] 4,165,048

[45] Aug. 21, 1979

[54] POSITIVE FEED

[76] Inventor: Horst Paepke, Fasanenweg 30, 7407 Rottenburg, Fed. Rep. of Germany

[21] Appl. No.: 821,309

[22] Filed: Aug. 2, 1977

[30] Foreign Application Priority Data

Aug. 12, 1976 [DE] Fed. Rep. of Germany ..... 2636224
Apr. 7, 1977 [DE] Fed. Rep. of Germany ..... 2715578

[51] Int. Cl.[2] ..... B65H 51/20; B65H 51/32; D04B 15/48

[52] U.S. Cl. ..... 242/47.01; 66/132 T; 74/230.01

[58] Field of Search ..... 66/132 T, 132 R; 242/47.01, 47.12; 74/217.5, 224, 242 R, 242.4, 242.5, 242.05, 230.01

[56] References Cited

U.S. PATENT DOCUMENTS

| | | | |
|---|---|---|---|
| 3,785,176 | 1/1974 | Hebbecker et al. | 66/132 T |
| 3,796,386 | 3/1974 | Tannert | 242/47.01 X |
| 3,854,307 | 12/1974 | Seibold | 242/47.01 X |
| 4,004,438 | 1/1977 | Raisin | 66/132 R |
| 4,047,398 | 9/1977 | Fecker et al. | 66/132 R |

FOREIGN PATENT DOCUMENTS

| | | | |
|---|---|---|---|
| 2160161 | 6/1973 | Fed. Rep. of Germany | 66/132 R |

*Primary Examiner*—Werner H. Schroeder
*Assistant Examiner*—Andrew M. Falik
*Attorney, Agent, or Firm*—Michael J. Striker

[57] ABSTRACT

A thread-supply arrangement for use in textile-manufacturing machines includes an accumulating drum which is mounted on a shaft and is to be selectively driven, together with other accumulating drums, when the shaft thereof is driven in rotation by an advancing belt or the like. A single pulley is mounted on the shaft for joint rotation therewith and for selected displacement longitudinally of the shaft between a plurality of positions in different ones of which different advancing belts are trained about the single pulley. Lifting rollers lift the respective advancing belt from the pulley to enable the latter to assume a different one of the positions thereof. Each belt which is then not being trained about the pulley, may be supported on a guiding roller mounted on an arm endwise received in an aperture of the support on which the shaft is mounted. The lifting roller may be mounted, together with an additional lifting roller, each on one arm of a double-armed lever pivotally about the shaft between an extended and a retracted position and arrestable at least in the retracted position thereof.

17 Claims, 10 Drawing Figures

FIG. 3
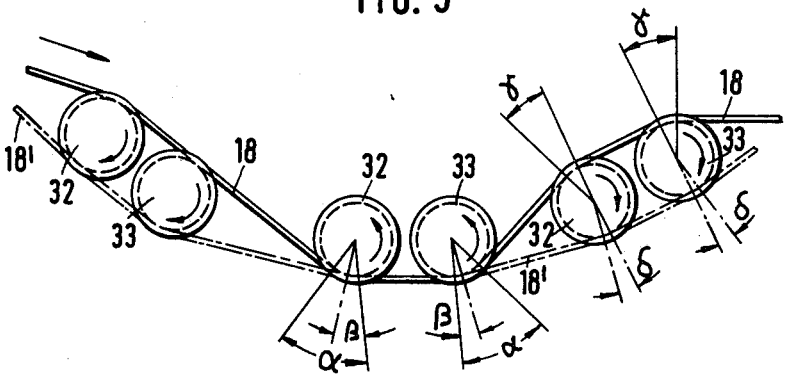
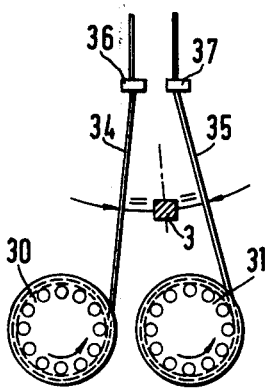
FIG. 4
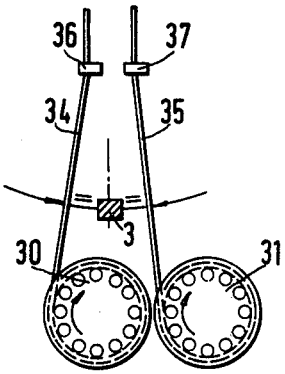
FIG. 5

POSITIVE FEED

BACKGROUND OF THE INVENTION

The present invention relates to a thread supply arrangement for use in textile machinery.

As is well known, a plurality of threads, such as single filaments, multi-filament fibers, yarns or the like-filamentary materials, hereafter collectively referred to as fibers, is to be supplied to a textile machine, such as a circular knitting machine, to be manufactured by the latter into a fabric or a similar textile material. To assure uniformity of advancement of the fibers toward the textile machine, it has already been proposed to mount an accumulating drum on the machine, on which drum the respective fiber is accumulated for a brief period of time prior to its delivery into the textile machine proper. Each of such accumulating drums associated with a respective fiber is driven in rotation at a predetermined speed, and usually all of the accumulating drums associated with the fibers then consumed by the textile machine, are simultaneously driven from a single drive by at least one, but usually more than one, endless advancing element, such as a belt. Usually, the fiber-supply arrangement also includes fiber-guiding means, such as eyelets, mounted on the same support as the accumulating drums and located both upstream and downstream of the respective accumulating drum as considered in the direction of advancement of the respective fiber.

Based on the above explanation, it will be apparent that the extensive use of the fiber-supply arrangements in at least some textile machines considerably reflects itself in the cost of manufacture, assembly, and operation of the textile machine. This is particularly true when, as explained above, different ones of the accumulating drums are separately or selectively driven in rotation by different advancing belts. Under these circumstances, it has been already proposed to arrange a plurality of pulleys on the driving shaft of the respective accumulating drum, each of such pulleys having trained about it one of the above-mentioned advancing belts. Inasmuch as the different advancing means are advanced at different speeds or at different times, it has been proposed to equip the individual pulleys with couplings which render it possible to connect, for joint rotation, only one of the plurality of pulleys with the shaft on which they are mounted. As a result of the provision of the complex pulleys provided with the coupling arrangements, such fiber-supply arrangements are rather expensive both in terms of construction and manufacture.

SUMMARY OF THE INVENTION

Accordingly, it is a general object of the present invention to avoid the disadvantages of the prior art.

More particularly, it is an object of the present invention to so construct a fiber-supply arrangement as not to be possessed of the disadvantages of the prior-art arrangements of this type.

A further object of the present invention is to so construct the fiber-supply arrangement as to be simple in construction, reliable in operation and inexpensive to manufacture.

A concomitant object of the present invention is to design a fiber-supply arrangement which is capable of being selectively driven by a single one of a plurality of advancing belts, either alone or simultaneously with a group of similar fiber-supply arrangements.

Yet another object of the present invention is to develop a fiber-supply arrangement which, in each of the operative positions thereof, works safely and without slippage.

In persuance of these objects, and others which will become apparent hereafter, one feature of the present invention resides, briefly stated, in a thread-supply arrangement for use in a textile-manufacturing machine which comprises, in combination, at least one shaft; means for mounting said shaft on the machine for rotation; an accumulator drum mounted on said shaft for joint rotation therewith; means for leading at least one thread toward and away from said accumulator drum; and means for rotating said shaft, including a pulley mounted on said shaft for joint rotation therewith and for displacement longitudinally thereof between a plurality of predetermined positions, and at least one endless advancing element trained about said pulley in a selected one of said positions thereof. Preferably, said mounting means includes a support mounted on the machine, and at least two bearings each mounting said shaft on said support at one longitudinal side of the pulley. Advantageously, there is provided means for releasably locking said pulley in each of said positions thereof to prevent inadvertent displacement thereof longitudinally of said shaft.

As will become apparent from the above, in the present invention in contradistinction to the prior-art fiber-supply arrangements, a single pulley is being used in conjunction with a plurality of advancing belts, such single pulley being displaceable along its associated shaft between the advancing regions of the individual advancing belts, and being arrestable in its selected position by means of a simple locking arrangement which need only lock the pulley against longitudinal displacement thereof along the shaft rather than couple the pulley to the shaft for joint rotation.

As mentioned above, the bearings mount the shaft on the support to the two longitudinal sides thereof so that the pulley is located on the shaft between the bearings. As a result of this double support of the shaft on the support, the forces which act on the pulley as a result of the tension of the respective advancing belt are incapable of deviating the fiber-supply arrangement from its operative position, which would otherwise, if permitted, result in a lowering of the belt tension and, consequently, in a slippage of the advancing belt relative to the pulley. This situation would, in turn, detrimentally reflect itself in the quality of the textile material produced from the fibers supplied by the fiber-supply arrangements.

Each of the plurality of advancing belts is associated with one of the plurality of positions of the single pulley of the respective fiber-supply arrangement having a respective accumulating drum. In this situation, it is advantageous to guide those of the advancing elements which are out of engagement with the pulley past and at a distance from the shaft of the respective fiber-supply arrangement. To achieve this, it is advantageous to provide the support with a plurality of apertures each associated with one of the positions of the pulley and with one of the advancing elements, and thereby provide guiding means which takes care of the above-discussed guidance and which includes at least one carrier arm which has an end portion selectively receivable in that aperture which is associated with the associated advancing element that is then out of contact with the pulley, and a guiding roller mounted on the carrier arm and guiding the respective advancing element past the shaft.

The simple carrier arms equipped with the guiding rollers need only be introduced into the above-discussed apertures, and the tension of the respective advancing element or belt trained about the guiding roller will safely keep the arms within the above-mentioned apertures. As briefly discussed before, the guiding rollers have the purpose of guiding the advancing belt which does not then drive the pulley about the shaft in order to hold the same in the region of the fiber-supply arrangement in a path which assures the needed tension of the respective advancing belt. In this manner, the otherwise present need for arranging additional tensioning rollers between the individual fiber-supply arrangements, can be avoided.

Advantageously, the fiber-supply arrangement is equipped with a device for lifting or disengaging the respective advancing belt from the pulley. Such a disengaging device may include at least one lever pivotable about the shaft of the fiber-supply arrangement between a retracted position and an extended position, and at least lifting roller freely rotatably mounted on said lever and in engagement with said one advancing element in said extended, while out of engagement therewith in said retracted, position said lever, the lifting roller being mounted on said lever at such a distance from of said shaft that the farthest point thereof from said shaft is more spaced from the latter than the farthest point of said pulley. Preferably, the respective fiber-supply arrangement is equipped with means for limiting the extent of pivoting of said lever to between said retracted and said extended position, the limiting means so determining the extended position that the lifting roller is located downstream of the middle point of contact of the one advancing element with the pulley in the retracted position, as considered in the advancing direction of said one advancing element. In an advantageous embodiment of the present invention, the above-mentioned lever has two arms each to one diametral side of said shaft and one of them carrying said lifting roller. Then, the disengaging means further includes an additional lifting roller similar to, and carried by the other arm of said lever similarly to, said lifting roller.

As a result of a simple pivoting of the two-armed lever from its retracted or rest position to its extended or lifting position, it is possible to lift the respective advancing belt off the pulley regardless of the fact whether the advancing belt is arranged at one side of the pulley in order to rotate the same in one direction, or to the other side of the pulley to rotate the same in the opposite direction. As a result of the fact that the two-armed lever, in its extended position, is beyond the plane defined by the axis of the shaft and the middle point of contact of the advancing belt with the pulley, it is achieved that the lever is maintained in the extended position thereof by a force attributable to the tension of the advancing belt which is trained about one of the two lifting rollers.

As already mentioned above, the fiber-supply arrangement of the present invention is especially suited for use with a plurality of endless advancing elements a selected one of which is trained about the pulley in a selected position of the latter. Under these circumstances, at least one further lifting roller may be freely rotatably mounted on a common axle with and adjacent to said lifting roller, each of said lifting rollers being associated with a different one of said advancing rollers. Alternatively, the lifting roller may have such dimensions as to cooperate with two or more of the advancing elements to lift the same off said pulley in said extended position of said lever. In either of these situations, the fiber-supply arrangement is compatible with textile machines in which the plurality of fiber-supply arrangements is subdivided into groups each of which is driven in rotation by a separate advancing belt. In this connection, it is customary for the multiple advancing belts to be guided parallel to one another in those regions which they enter simultaneously. This last-mentioned embodiment of the present invention is also suited for such proposed fiber-supply arrangements of the above-discussed kind in which only a single pulley is mounted between two bearings on a shaft for displacement longitudinally of the shaft between a plurality of finite positions determined by the above-mentioned locking means.

The afore-mentioned limiting means may include an abutment on the mounting means and cooperating with said lever in both pivoting directions. Furthermore, there can be provided means for arresting said lever at least in said retracted position thereof.

A further decrease in cost can be achieved when the fiber-supply arrangement includes an additional shaft mounted on said support at a distance from and parallel to said shaft, and an additional accumulator drum and pulley mounted on said additional shaft. The support may include a connecting element, and then the shaft and the additional shaft are arranged asymmetrically with respect to said connecting element in dependence on the direction of rotation of said shafts. In this manner, the same delivery and withdrawal conditions are obtained at both accumulating drums of the respective fiber-supply arrangement, and the fibers which are guided over the two accumulating drums have to overcome the same frictional resistance during their advancement in separate paths so that, in this manner, the uniformity of the structure of the textile product produced on the textile machine is assured.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

BRIEF DESCRIPTION OF THE DRAWINGS

FIG. 3 is a diagrammatic view illustrating an assembly of a plurality of fiber-supply arrangements according to FIG. 2 as driven by a common advancing belt;

FIG. 4 is a diagrammatic top plan view of the fiber-supply arrangement of FIG. 2 for one direction of rotation;

FIG. 5 is a view similar to FIG. 4 but for the opposite direction of rotation;

DETAILED DISCUSSION OF THE PREFERRED EMBODIMENTS

Figure 1:
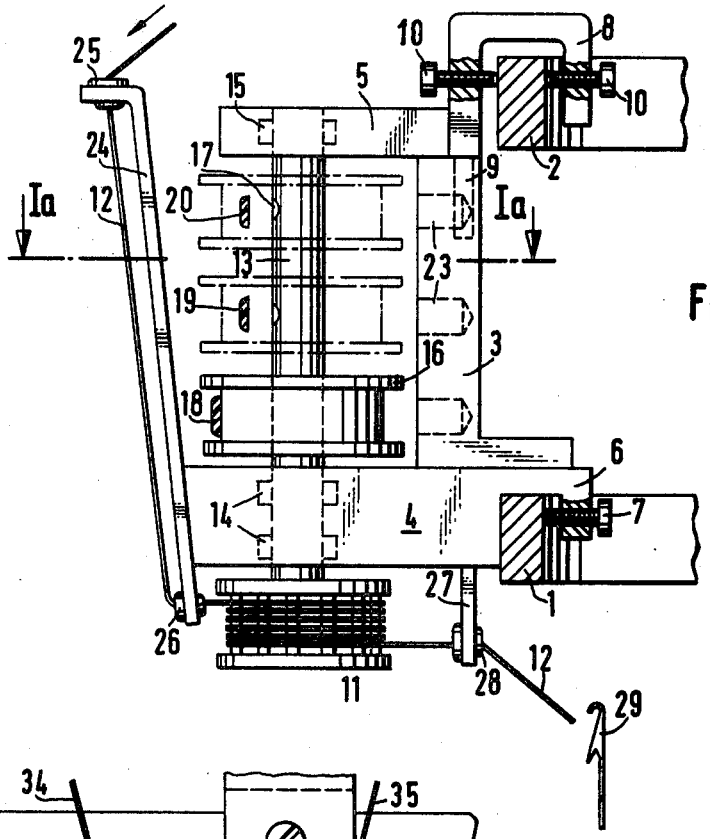
FIG. 1 is a partly sectioned side elevational view of a fiber-supply arrangement of the present invention.

Referring now to the drawing in detail, it may be seen therein that the fiber-supply arrangement of the present invention illustrated therein is especially suited for use in circular knitting machines. Of such a machine, there is illustrated a lower carrier ring 1 and an upper carrier ring 2 on which the fiber-supply arrangements of the present invention are supported in a manner which will be discussed in more detail as the description proceeds. Each of the fiber-supply arrangements includes a support member 3, on which there is mounted a lower mounted plate 4 which extends transversely of the support member 3 and an upper mounting plate 5 which also extends transversely of the mounting member 3. As illustrated most clearly in FIG. 1, the lower mounting plate 4 is formed with hook-shaped extensions 6 which embrace the lower carrier ring 1 and on which there is mounted a connecting screw 7 by means of which the lower mounting plate 4 and thus the entire fiber-supply arrangement is clamped on the lower carrier ring 1 of the textile machine.

The support member 3 is provided, at its upper end, with a support bracket 8 which has, on one of its arms, a bearing pin 9 which is received in a receiving hole of the support member 3 for longitudinal movement. The accommodation of the bearing pin 9 in its associated hole for longitudinal movement renders it possible to lift the support bracket 8 upwardly, preferably against the force of a non-illustrated conventional spring, and to subsequently tilt the supporting bracket 8. In each of the arms of the support bracket 8, there is supported one support screw 10 by means of which the support bracket 8 is supported on the upper carrier ring 2 of the textile machine.

In the embodiment illustrated in FIG. 1, the fiber-supply arrangement includes only a single accumulating drum 11 for a fiber or thread 12, such as a filament, a multifilament fiber, a yarn or the like, filamentary material which is to be supplied to the textile machine. The accumulating drum 11 is mounted underneath the lower mounting plate 4 on a driving shaft 13 which passes through the lower mounting plate 4 and reaches all the way up to the upper mounting plate 5. The driving shaft 13 is mounted in the lower mounting plate 4, as well as in the upper mounting plate 5, by respective bearings 14 and 15 which are diagrammatically indicated in FIG. 1 of the drawing.

A single pulley 16 is mounted on the driving shaft 13 in the region between the lower mounting plate 4 and the upper mounting plate 5 of the fiber-supply arrangement, for displacement longitudinally of the driving shaft 13. The sole pulley 16 is lockable in three different operating positions by means of a simple locking arrangement which couples the pulley 16 with the driving shaft 13. As illustrated in FIG. 1, the pulley 16 is illustrated in its lowest operating position. The two operating positions which are located above the one operating position are indicated in FIG. 1 by the pulley 16 shown in broken lines, and by locking depressions 17 provided in the driving shaft 13 and into which the locking arrangement of conventional construction engages in each of the operating positions of the pulley 16.

At the elevation of each operating position of the pulley 16, there is guided an advancing belt 18, 19 or 20 which is common to a multitude of the fiber-supply arrangements. Of the advancing belts 18, 19 and 20, the advancing belt 18 is illustrated as being trained about the pulley 16 which is illustrated in its foremost position, and this belt 18 alone causes the accumulating drum 11 to rotate. The two remaining advancing belts 19 and 20 are conducted past the illustrated fiber-supply arrangement without affecting the same.

Figure 1A:
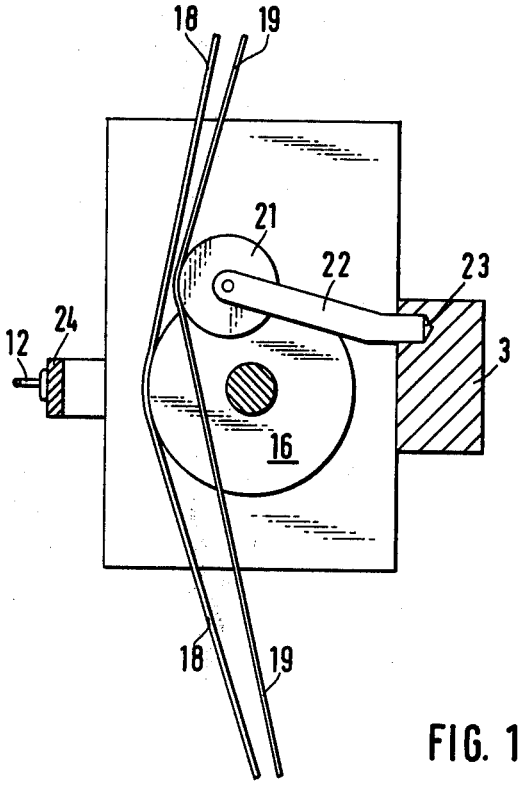
FIG. 1*a* is a section taken on line I*a*–I*a* of FIG. 1.

As illustrated in FIG. 1*a*, the then inoperative belt 19 or the inoperative belt 20 which is concealed behind the belt 19, can be guided on guide rollers 21 each of which is mounted at an end of a carrier arm 22 which is accommodated in an aperture 23 provided in the support member 3. The guiding rollers 21 are so arranged that those of the advancing belts 18, 19 or 20 which are then inoperative for driving a respective fiber-supply arrangement pass the shaft of such fiber-supply arrangement at a smaller distance therefrom than the then operative advancing belt 18, 19 or 20. In this manner, the inoperative advancing belts 18, 19 or 20 embrace the pulley 16 at the following fiber-supply arrangement where such belts 18, 19 or 20 are operative, with a greater wrap than if they were guided about the guiding rollers 21 at the same distance from the shaft 13 as the operative belt, as indicated by the angles $\alpha$ or $\gamma$ in FIG. 3.

On the lower mounting plate 4 there are mounted a first holding element 24 carrying two fiber-guiding eyelets 25 and 26, as well as a second holding arm 27 carrying a further fiber-guiding eyelet 28. The fiber 12 to be fed into the textile machine is guided toward the accumulating drum 11 via the two fiber-guiding eyelets 25 and 26, is accumulated on the accumulating drum 11 in a plurality of turns in a conventional manner, and is withdrawn from the accumulating drum 11 via the fiber-guiding eyelet 28 and supplied to a location of use which is symbolically indicated in FIG. 1 by a needle 29.

Figure 2:
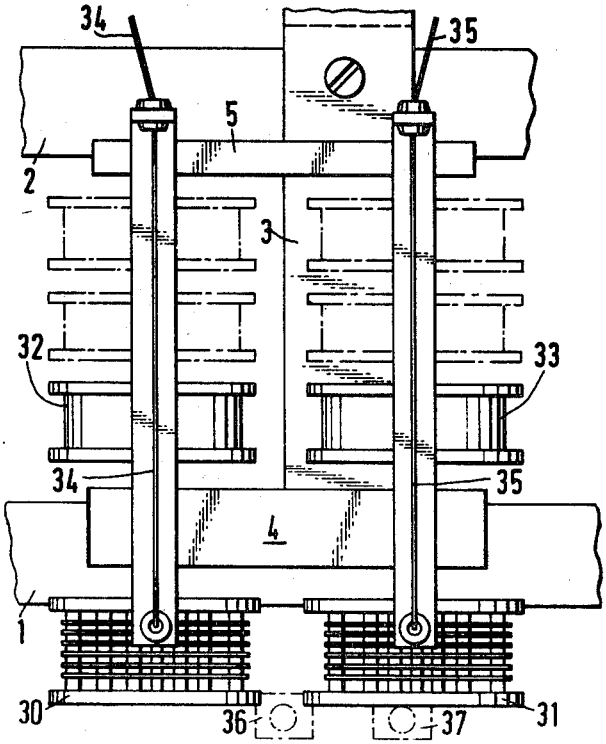
FIG. 2 is a front elevational view of a fiber-supply arrangement of the present invention equipped with two accumulating drums.

In the embodiment of the present invention illustrated in FIG. 2, the fiber-supply arrangement includes two accumulating drums 30 and 31 each of which is mounted on a separate driving shaft, each of which carries a single pulley 32 or 33 which is displaceable longitudinally of the driving shaft between the various operating positions thereof in the same manner as discussed previously in connection with FIG. 1. The two separate accumulating drums 30 and 31 are adapted and used for accumulating different fibers 34 and 35, respectively.

As can be further ascertained from FIG. 2, the two accumulating drums 30 and 31, together with their driving shafts, are mounted on the two mounting plates 4 and 5 asymmetrically with respect to the support member 3. The extent and direction of asymmetry are dependent on the dimensions of the pulleys 32 and 33 and on the direction of rotation thereof and of the drums 30 and 31. This aspect of the present invention is more clearly apparent from the diagrammatic illustrations of FIGS. 4 and 5, of which FIG. 4 illustrates the conditions prevailing when the two accumulating drums 30 and 31 rotate in counterclockwise direction, while FIG. 5 illustrates the conditions existing when the two accumulating drums 30 and 31 rotate in the clockwise direction. In both instances, the asymmetric support of the two accumulating drums 30 and 31 with respect to the support member 3 is so selected that the two fibers 34 and 35 are withdrawn from the respective accumulating drums 30 and 31 symmetrically to the support member 3. The downstream fiber-guiding eyelets 36 and 37 are then correspondingly attached to the lower mounting plate 4.

The different directions of rotation of the accumulating drums 30 and 31 result from the guidance of the advancing belt 18 around the pulleys 32 and 33 of consecutive fiber-supply arrangements, as illustrated in FIG. 3. This type of guidance of the belt 18 is selected in order to obtain a greater region of contact of the belt 18 with the pulleys 32 and 33 than otherwise possible as illustrated in FIG. 3 by the angles $\alpha$ or $\gamma$. On the other hand, if the advancing belt 18 were guided along the path indicated, in broken lines, in FIG. 3 at 18', there would result only smaller contact angles $\beta$ or $\delta$ at which the belt 18 would contact the pulleys 32 or 33, as also illustrated in FIG. 3.

Figure 6:
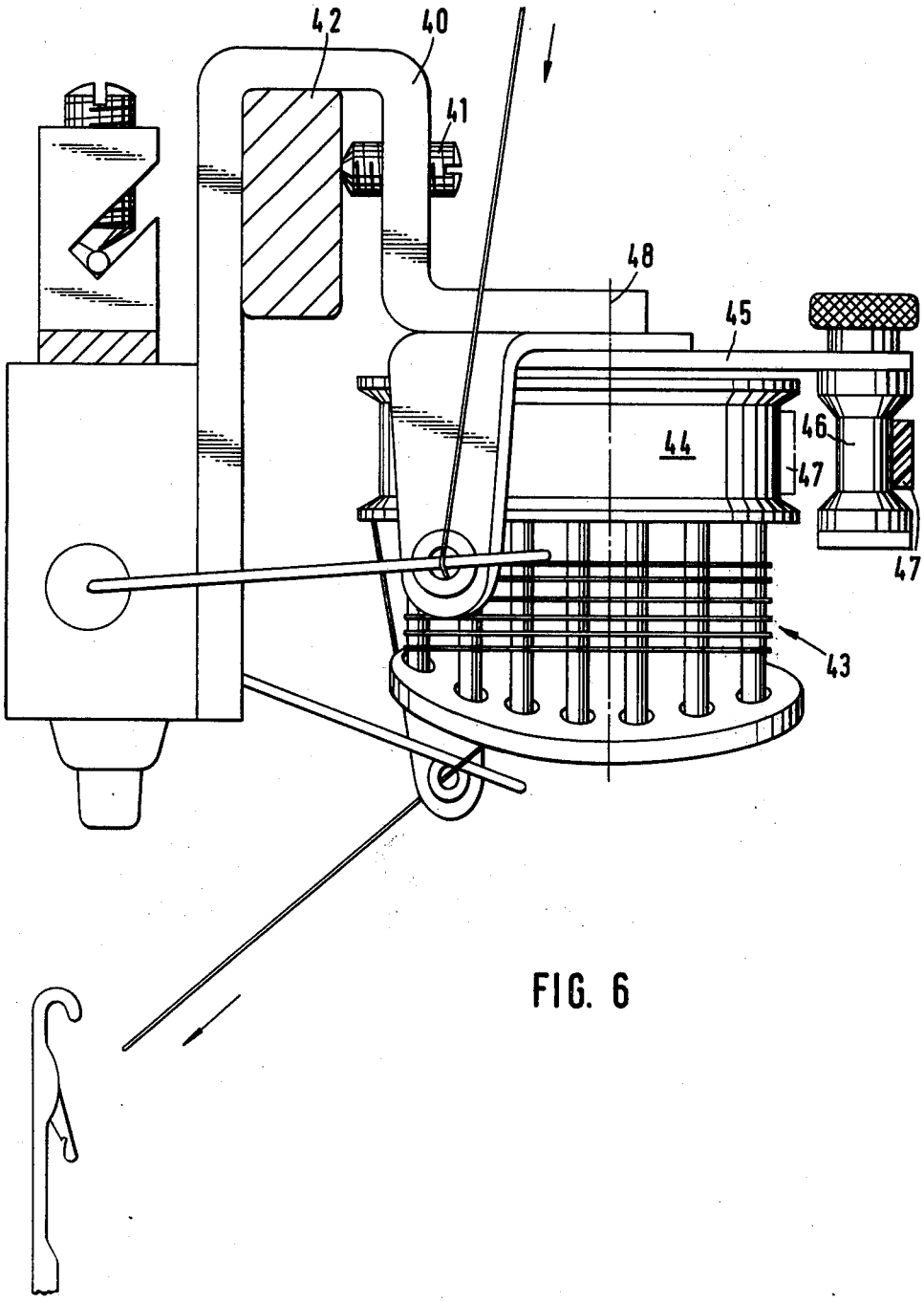
FIG. 6 is a side elevational view of a further embodiment of the fiber-supply arrangement of the present invention.

FIG. 6 illustrates an example of the embodiment of the fiber-supply arrangement of the present invention in which an accumulating drum 43 is mounted in a bracket-shaped support 40 which is mounted on a carrier ring 42 of a circular knitting machine by means of a clamping screw 41. The upper part of the accumulating drum 43 is directly configurated as a pulley 44. A pivotable lever 45 is arranged between a non-illustrated stationary support part of the accumulating drum 43 and the support 40. The pivotable lever 45 carries, at its free end, a lifting roller 46 for an advancing belt 47. The pivotable lever 45 can be pivoted, from its illustrated lifting position, about an axis 48 by approximately 90° rearwardly beyond the plane of the drawing so that the advancing belt 47 can then engage the pulley 44 as illustrated in FIG. 6 in broken lines.

Figure 7:
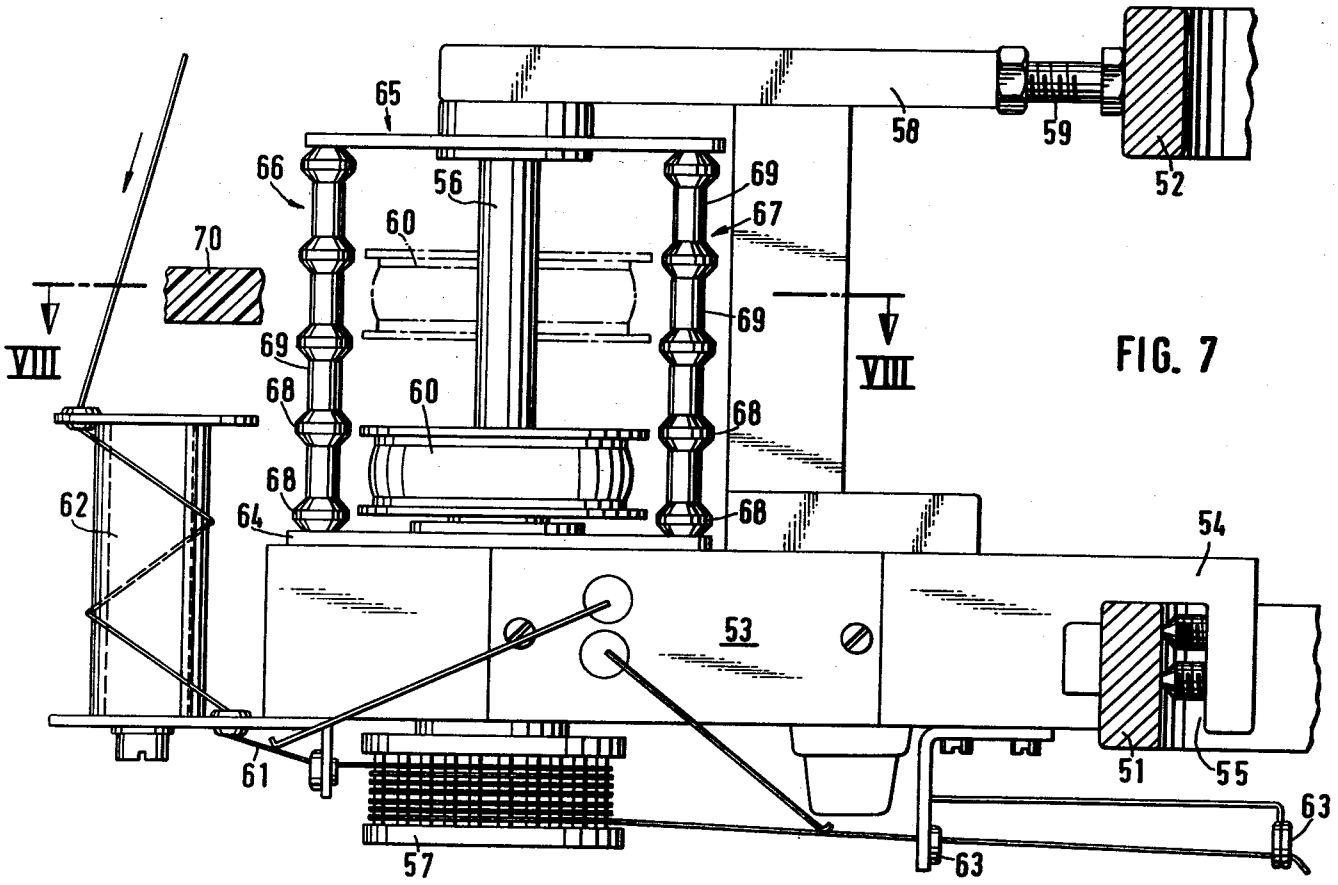
FIG. 7 is a side elevational view of a further modification of the fiber-supply arrangement of the invention, illustrating only the most important parts.

FIG. 7 illustrates a lower carrier ring 51 and an upper carrier ring 52 of a circular knitting machine, on which the fiber-supply arrangements are supported or to which they are connected in a distributed relationship with respect to one another about the circumference of the textile machine.

In this embodiment of the present invention, the fiber-supply arrangement consists of a housing 53 having a rear support part 54 which has a depression 55 into which the carrier ring 51 of the circular knitting machine penetrates. The carrier ring 51 can be provided, in a known manner, with electric current contact rails through which, and via contact locations which are not illustrated in detail, electric current is delivered to electric circuitry and various components thereof which are accommodated in the housing 53 of the fiber-supply arrangement.

A driving shaft 56 is supported in the housing 53, which shaft 56 is vertically conducted through the housing 53 and has a lower end on which there is supported an accumulating drum 57. Several convolutions of a fiber 61 are trained about the accumulating drum 57, the fiber 61 which is withdrawn from a non-illustrated pay out spool being guided over a braking cylinder 62 and being conducted, downstream of the accumulating drum 57 as considered in the supply direction of the fiber 61, through fiber-guiding eyelets 63 toward a non-illustrated textile-manufacturing location.

The upper end of the driving shaft 56 is supported in a bridge 58 which is supported on the upper carrier ring 52 of the machine by means of an adjustable screw 59. A pulley 60 is so connected to the driving shaft 56 that it is capable of selectively assuming four different operational positions, being lockable therein by non-illustrated locking arrangements. The pulley 60 is illustrated as located in its lowermost position and also, in broken lines, in one of its upper positions.

The fiber-supply arrangement is equipped with a lifting device for lifting the respective advancing belts, which lifting device includes a pair of identical double-armed levers 64 and 65 which are pivotably mounted, at a distance from one another, on the driving shaft 56. Between each two of the free ends of the two levers 64 and 65, there extends a lifting roller 66 or 67 which is freely rotatably supported on the levers 64 and 65. Advantageously, each of the lifting rollers 66 and 67 is mounted on an axle which extends between the two levers 64 and 65. The lifting rollers 66 and 67 are profiled and separated, by means of intermediate bulges and end bulges 68, into four mutually separated belt-contact regions 69. As a result of this configuration of the lifting rollers 66 and 67, up to four parallel advancing belts 70, of which one is indicated in FIG. 7 in partial front elevation, can be simultaneously lifted.

Figure 8:
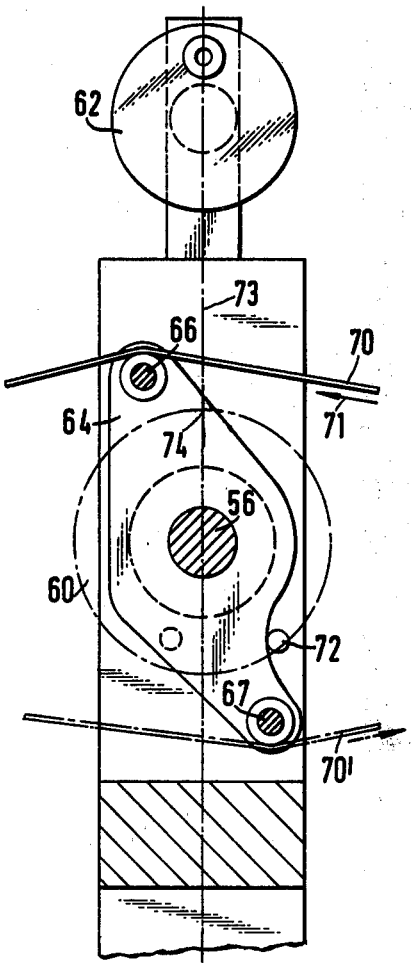
FIG. 8 is a sectional view taken on the line VIII—VIII of FIG. 7 in an extended position of a lifting device.
Figure 9:
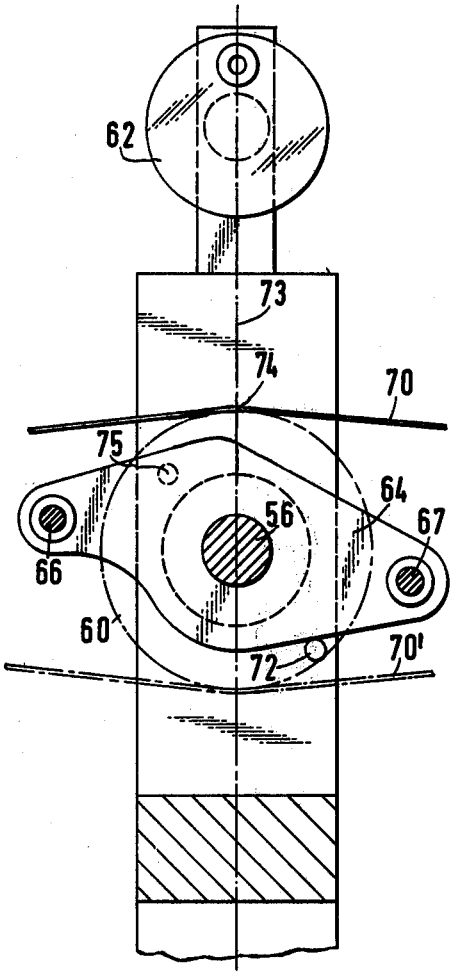
FIG. 9 is a view similar to FIG. 1 but in a retracted position of the lifting device.

Each of the FIGS. 8 and 9 shows a top plan view of the two armed-lever 64 of the belt-lifting arrangement. FIG. 8 illustrates the lifting arrangement in its extended or lifting position. It will become apparent upon considering FIGS. 8 and 9 that the two lifting rollers 66 and 67 are arranged at such a distance from the longitudinal axis of the driving shaft 56, which also constitutes the pivoting axis of the two-armed lever 64, which exceeds the radius of the pulley 60 which is also mounted on the driving shaft 56. As a result thereof, in the extended position illustrated in FIG. 8, the advancing belts 70 are in contact with the lifting roller 66 and thus lift it from the pulley 60 so that the pulley 60 is no longer driven in rotation. The direction of advancement of the belt 70 is designated with the arrow 71. Given this advancing direction 71, there results a rotation of the pulley 60, when the belt 70 is in engagement therewith, in the counterclockwise direction. As illustrated by a dash-line 70', the belt 70 could also be arranged at the other diametral side of the pulley 60, in which event it would be guided over the lifting roller 67 in the extended position illustrated in FIG. 8.

An abutment pin 72 stationarily mounted on the housing 53 limits the extent of pivoting of the two-armed lever 64. In the extended or lifting position, the lever 64 is pivoted from the rest or retracted position illustrated in FIG. 9, in the counterclockwise direction, by more than 90° so that the lifting roller 66 is pivoted beyond the symmetry plane of the fiber-supply arrangement indicated by a dash-dotted line 73. The lifted advancing belt 70 thus contacts the lifting roller 66 beyond a middle contact point 74 of the belt 70 with the pulley 60, as considered in the direction of advancement of the belt 71, so that the tension existing in the belt 70 subjects the lifting arrangement to a moment in the counterclockwise direction, which moment then holds the two-armed lever 64 in contact with the abutment pin 72. Even in the situation when the belt 70 is conducted in the path 70' over the lifting roller 67, the belt 70 subjects the lifting device to a contact pressure which prevents the lifting device from returning into its retracted or rest position and which holds the lifting device in contact with the abutment pin 72.

In the rest or retracted position illustrated in FIG. 9, assumed by the lifting device, the two lifting rollers 66 and 67 which are mounted on the two-armed lever 64 and 65 are disengaged from the belt 70 or 70' and the belt 70 is in contact with a certain portion of the circumference of the pulley 60 to the two sides of the middle point of contact 74. Even in this rest position, the two-armed lever 64 is in contact with the abutment pin 72. A securing of the lifting device against an undesirable pivoting movement in direction toward the extended position thereof can be achieved by means of an arresting arrangement 75 which is not illustrated in detail because it is conventional. Such an arresting arrangement may include, for instance, a spring-biased spear 75 cooperating with a detent depression in the juxtaposed part.

It will be understood that each of the elements described above, or two or more together, may also find a useful application in other types of constructions differing from the types described above.

While the invention has been illustrated and described as embodied in a fiber-supply arrangement for use in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a thread-supply arrangement for use in a textile manufacturing machine, a combination comprising at least one shaft; means for mounting said shaft on the machine for rotation; an accumulator drum mounted on said shaft for joint rotation therewith; means for leading at least one thread toward and away from said accumulator drum; means for rotating said shaft, including a pulley mounted on said shaft for joint rotation therewith and for displacement longitudinally thereof between a plurality of predetermined positions, and at least one endless advancing element trained about said pulley in a selected one of said positions thereof; and means for disengaging said one advancing element from said pulley to release the latter for displacement longitudinally of said shaft, said disengaging means including at least one lever pivotably about said shaft between a retracted position and an extended position, and at least one lifting roller freely rotatably mounted on said lever and in engagement with said one advancing element in said extended position while being out of engagement therewith in said retracted position of said lever, said lifting roller being mounted on said lever at such a distance from said shaft that the farthest point thereof from said shaft is spaced from the latter in excess of the radius of said pulley.

2. A combination as defined in claim 1; and further comprising means for limiting the extent of pivoting of said lever to between said retracted and said extended position; and wherein said limiting means so determines said extended position that said lifting roller therein is located downstream of the middle point of contact of said one advancing element with said pulley in said retracted position, as considered in the advancing direction of said one advancing element.

3. A combination as defined in claim 2, wherein said lever has two arms each to one diametral side of said shaft and one of them carrying said lifting roller; and wherein said disengaging means further includes an additional lifting roller similar to, and carried by the other arm of said lever similarly to said lifting roller.

4. A combination as defined in claim 2, wherein said lifting means includes an abutment on said mounting means and cooperating with said lever in both pivoting directions.

5. A combination as defined in claim 1; and further comprising means for arresting said lever at least in said retracted position thereof.

6. A combination as defined in claim 1; further comprising at least one additional endless advancing element trained about said pulley in a different one of said positions thereof; and wherein said disengaging means further includes an axle mounting said lifting roller on said lever, and at least one further lifting roller freely rotatably mounted on said axle adjacent to said lifting roller and associated with said additional advancing element.

7. A combination as defined in claim 1; further comprising at least one additional endless advancing element trained about said pulley in a different one of said positions thereof; and wherein said lifting roller is associated with both said advancing element and said additional advancing element to lift the same off said pulley in said extended position of said lever.

8. A combination as defined in claim 1, wherein said lever includes two lever components spaced from one another longitudinally of said shaft; and wherein said disengaging means includes an axle mounted on said lever components and mounting said lifting roller therebetween.

9. A combination as defined in claim 1, wherein said mounting means includes a support mounted on the machine; and at least two bearings each mounting said shaft on said support at one longitudinal side of said pulley.

10. A combination as defined in claim 9, wherein said mounting means further includes a support portion of said support which embraces a part of the machine, and support screws on said support and on said support portion which engage the above-mentioned part of the machine.

11. A combination as defined in claim 10, wherein said mounting means mounts said support on the machine for movement between an operative and an inoperative position, and for tilting in said inoperative position; and further comprising means for urging said support toward said operative position thereof.

12. In a thread-supply arrangement for use in a textile manufacturing machine, a combination comprising at least two shafts; means for mounting said shafts on the machine for rotation about parallel and distant axes, including a support mounted on the machine, and at least two bearings for each of said shafts which are spaced axially of the respective shaft and mount the same on said support; at least two accumulator drums each mounted on one of said shafts for joint rotation therewith; means for leading at least one thread toward and away from each of said accumulator drums; and means for rotating each of said shafts, including a pulley mounted on the respective shaft intermediate the respective bearings for rotation with and for axial displacement relative to the respective shaft between a plurality of predetermined positions, to effect its engagement with a selected one of a plurality of advancing elements.

13. A combination as defined in claim 12; wherein said support includes a connecting element; and wherein said shaft and said additional shaft are arranged asymmetrically with respect to said connecting element in dependence on the direction of rotation of said shafts.

14. In a thread-supply arrangement for use in a textile manufacturing machine, a combination comprising at least one shaft; means for mounting said shaft on the machine for rotation; an accumulator drum mounted on said shaft for joint rotation therewith; means for leading at least one thread toward and away from said accumulator drum; means for rotating said shaft, including a pulley mounted on said shaft for joint rotation therewith and for displacement longitudinally thereof between a plurality of predetermined positions, to effect its engagement with a selected one of a plurality of advancing elements; and means for disengaging said one advancing element from said pulley to release the latter for displacement longitudinally of said shaft.

15. In a thread-supply arrangement for use in a textile manufacturing machine, a combination comprising at least one shaft; means for mounting said shaft on the machine for rotation; an accumulator drum mounted on said shaft for joint rotation therewith; means for leading at least one thread toward and away from said accumulator drum; means for rotating said shaft, including a pulley mounted on said shaft for joint rotation therewith and for displacement longitudinally thereof between a plurality of predetermined positions, and at least two endless advancing elements each trained about said pulley in a different selected one of said positions thereof; and means for guiding past said shaft that respective of said advancing elements which is out of engagement with said pulley, including means bounding in said mounting means a plurality of apertures each associated with one of said positions of said pulley and with one of said advancing elements, at least one carrier arm having an end portion selectively receivable in that of said apertures which is associated with said respective advancing element, and a guiding roller mounted on said carrier arm and guiding said respective advancing element past said shaft.

16. In a thread-supply arrangement for use in a textile manufacturing machine, a combination comprising at least one shaft; means for mounting said shaft on the machine for rotation; an accumulator drum mounted on said shaft for joint rotation therewith; means for leading at least one thread toward and away from said accumulator drum; means for rotating said shaft, including a pulley mounted on said shaft for joint rotation therewith and for displacement longitudinally thereof between a plurality of predetermined positions, to effect its engagement with a selected one of a plurality of advancing elements; and means for releasably locking said pulley in each of said positions thereof.

17. In a thread-supply arrangement for use in a textile manufacturing machine, a combination comprising at least one shaft; means for mounting said shaft on the machine for rotation; an accumulator drum mounted on said shaft for joint rotation therewith; means for leading at least one thread toward and away from said accumulator drum; and means for rotating said shaft, including a single pulley mounted on said shaft for joint rotation therewith and for displacement longitudinally thereof between a plurality of predetermined positions, and at least two endless advancing elements a different one of which is trained about said pulley, while the other of said advancing elements bypasses said pulley and said shaft, in each of two selected positions of said pulley.

* * * * *